United States Patent [19]

Ogura

[11] Patent Number: 4,887,764

[45] Date of Patent: Dec. 19, 1989

[54] PACKAGING BOX HAVING AN IMPROPER TEAR PREVENTION STRUCTURE

[75] Inventor: Yoshiharu Ogura, Osaka, Japan

[73] Assignee: Ogura Art Printing Co., Ltd., Osaka, Japan

[21] Appl. No.: 212,705

[22] Filed: Jun. 28, 1988

[30] Foreign Application Priority Data

Feb. 22, 1988 [JP] Japan ..... 63-38803

[51] Int. Cl.[4] ..... B65D 5/08

[52] U.S. Cl. ..... 229/102; 229/151; 206/807

[58] Field of Search ..... 229/102, 153, 151; 206/807; 220/463, 416, 410, 441, 443

[56] References Cited

U.S. PATENT DOCUMENTS

| | | | |
|---|---|---|---|
| 1,196,365 | 8/1916 | Jennings | 229/151 |
| 1,986,145 | 1/1935 | Goodyear | 229/151 X |
| 2,389,291 | 11/1945 | Bergstein | 220/416 X |
| 2,491,206 | 12/1949 | Potts | 229/151 X |
| 4,479,588 | 10/1984 | Davis et al. | 220/416 |
| 4,573,634 | 3/1986 | Kohler et al. | 206/807 |
| 4,614,297 | 9/1986 | Davis et al. | 206/807 X |

*Primary Examiner*—Jimmy G. Foster
*Assistant Examiner*—Jes F. Pascua
*Attorney, Agent, or Firm*—Fleit, Jacobson, Cohn, Price, Holman & Stern

[57] ABSTRACT

The present invention relates to a packaging box with a cover plate and base plate for closing the top and bottom openings of a quadrangular cylindrical body for holding medical supplies or the like, and provides a tear prevention function to keep the medical supplies or the like held inside the box out of risks of mischief and pilferage.

4 Claims, 7 Drawing Sheets

FIG. 2.
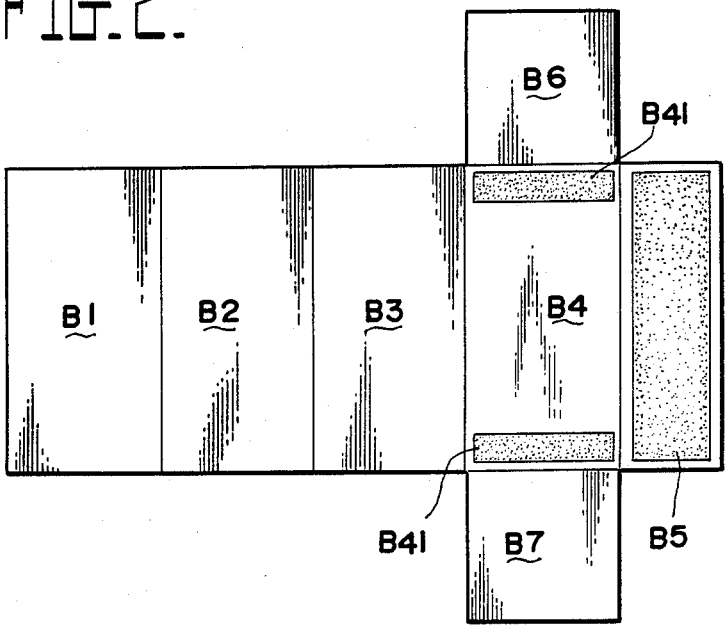
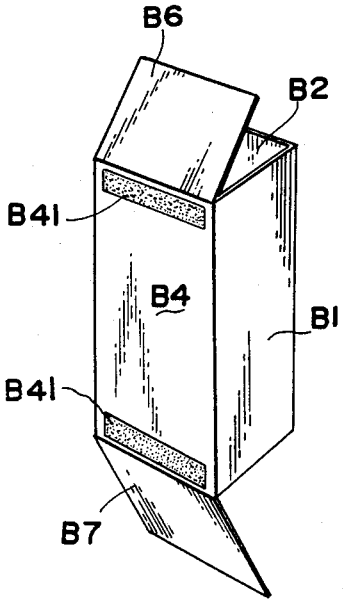
FIG. 3.

PACKAGING BOX HAVING AN IMPROPER TEAR PREVENTION STRUCTURE

BACKGROUND OF THE INVENTION

The present invention relates to a packing box, and in particular to packaging box having a structure allowing no improper tear.

Generally, the structure of packaging box forms a body in a quadrangular cylindrical cardboard body with a front and back wall and a left and right side wall, and adopts basically a structure allowing openings, which are formed respectively at opposite top and bottom ends of the cylindrical body, to be opened and closed by folding the cover plate and bottom plate, which block off the openings, over the opposite top and bottom ends of the front wall.

Among these packaging boxes, particularly if the use is for holding medical supplies or the like, it is considered necessary to provide a function thereby making it impossible to rig a tear in order to prevent such risks as mischief or pilferage made against the contents.

For this purpose, pharmacists have added to the box structure of preventing tear or conversion. As the system that prevents an improper tear, it concentrates on the cover plate and base plate portion which can most easily be tricked for tearing.

The means which has heretofore been adopted for preventing improper tear and falsification, however, mostly adopts a double construction in the cover plate and base plate portion which would make it easy to detect a tear mark if the box should be torn, but the structure is complicated and inadvantageous for the manufacturing purpose, and it is a defect that a risk still remains for the contents which are possible to be taken out without giving any damage to the cover plate or base plate when they are torn carefully by means of a sharp knife or the like at the portion, for example, (overlap width), excluding the cover plate and base plate.

A packaging box provided with an improper tear prevention structure having the following construction was proposed by the inventor for solution of these defects as mentioned above:

(1) The cover and base plates, each with a foldably connected, adhesive tongue flap, are arranged connectively and foldably to lead respectively to the top and bottom of the back wall plate of the cylindrical box body so that the top and bottom opening surfaces can be blocked off.

(2) A uniform length of fold flap is arranged to lead connectively to the top and bottom of the front wall plate of the cylindrical box body, the said fold flap being folded inside the cylindrical box body so as to make a nearly adherent contact to the inner surface of the front wall plate.

(3) At folding section (the line bordering on the front wall) of the contact plate folded inside, a rib-tube opening is formed for inserting the adhesive tongue flap which is arranged to lead connectively to the tip of the cover plate or base plate.

(4) On the occasion of fabrication of the box body, the back of the adhesive tongue flap, which is arranged to lead connectively to the cover plate or base plate, is coated with adhesive (in the convention packaging box, the adhesive is coated on the surface of tongue flap), this adhesive coated surface being bonded with the inside of the fold flap located in the surface corresponding thereto.

(5) As a result that the back of tongue flap and the inside of the fold flap are bonded together, the adhesive coated surface becomes untouchable at all from the outside. This is the construction as referred to in the above.

In the case of the above mentioned construction, in the point that the improper tear can be prevented, it was remarkably superior to the conventional construction, while the fabrication of the box body requires a special kind of technology due to the complexities of the construction which is to be the other party to which the insert tongue flap arranged to lead connectively to the tip of the cover plate and base plate is recessed, i.e. the the complexities of the structure of the contact flap which was constructed so as to be arranged to lead connectively to the top and bottom of the front wall plate for being folded inside.

SUMMARY OF THE INVENTION

The object of the present invention is to provide a packaging box which makes it at all impossible for the block-off adhesive surface to be touched from the outside, thereby assuring the safety of the contents.

Another object of the present invention is to secure the packaging box using the construction of a conventionally made outer box body, while the adhesive surface can not at all be touched from the outside after the whole box body once fabricated.

The means of the present invention is, by arranging the left, back, right and front walls to lead connectively one by one, to constitute a box body, and further constituting the walls such that the top and bottom opening areas of the box body can be blocked off with a cover plate and a base plate each having a fold tongue flap at their tips, and including a separate inner frame body which at least can be contacted with the inside surface of the box body, recess the said inner frame body into the box body, and bond the adhesive applied to the back of the fold tongue flap solidly with the outer surface of the inner frame body recessed into the inside of the box body.

BRIEF DESCRIPTION OF THE DRAWINGS

FIG. 2 is an expanded plan view of the inner frame body.

FIG. 3 is a perspective view showing the fabrication state of the inner frame body.

BEST MODE OF CARRYING OUT THE INVENTION

Figure 1:
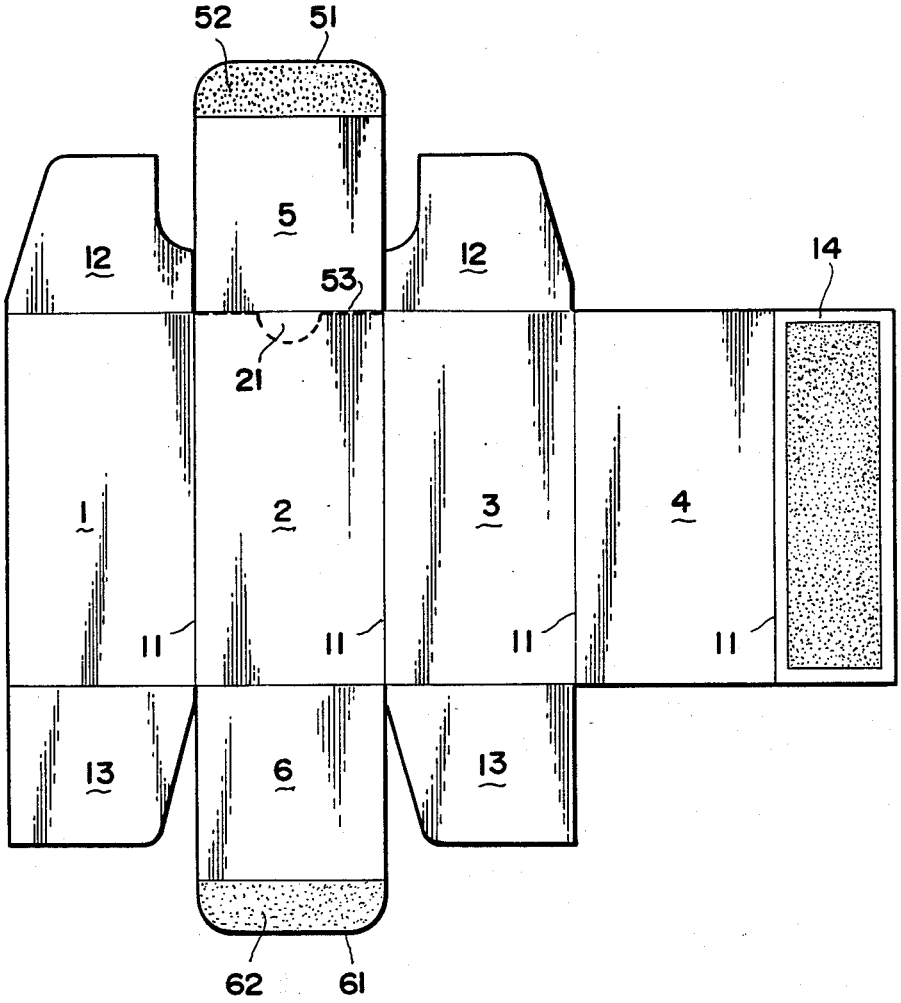
FIG. 1 of the drawings is an expanded plan view of the packaging box having an improper tear prevention structure in relation to the present invention.
Figure 4:
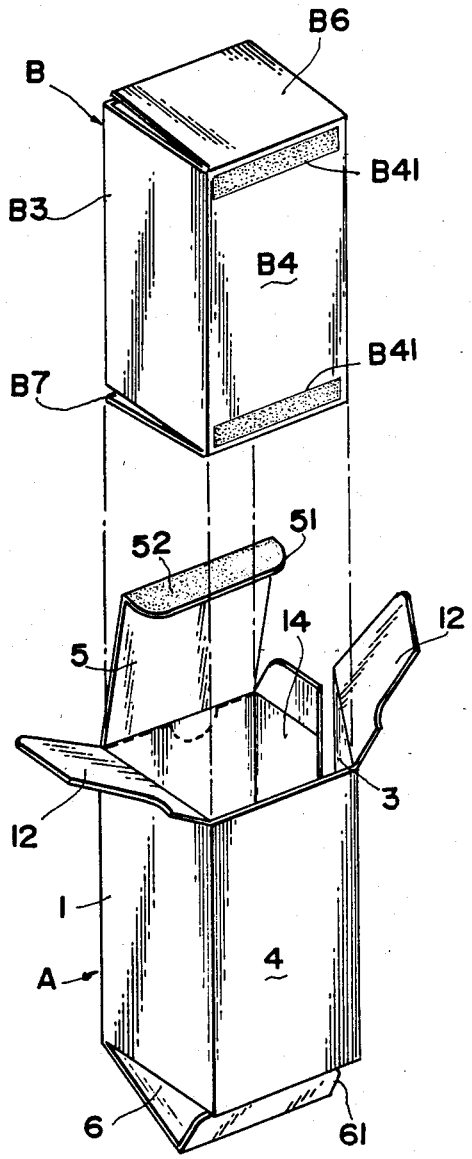
FIG. 4 is a decomposed perspective view showing the inner frame body recessed into the box body.
Figure 5:
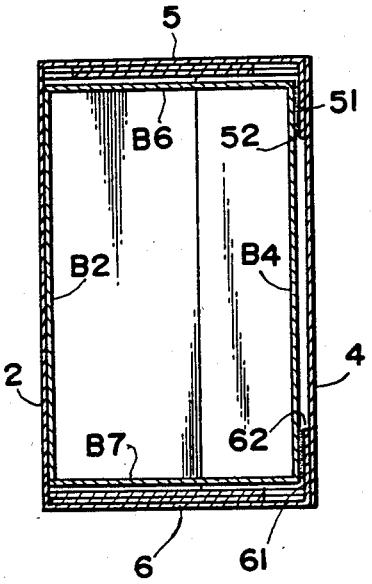
FIG. 5 is a longitudinal sectional side view of fabricated packaging box.

The present invention is constituted with a sheet of paper for constructing the box body A and another sheet of paper for constructing the inner frame body B which contacts the inside of the box body A.

The sheet of paper for constructing the box body A is formed to make a sequential connection of the left side wall flap 1, back wall flap 2, right side wall flap 3 and front wall flap 4 via the fold line 11 . . . 11, and the cover plate 5 having a fold tongue flap 51 at its tip and the base plate 6 having a fold flap 61 at its tip are arranged to lead connectively and foldably to the top end and the bottom end of the back wall flap 2 respectively.

The left side wall flap 1 and right side wall flap 3 are arranged respectively at their top and bottom to lead connectively and foldably to the inner cover flaps 12, 12 and inner base flaps 13, 13.

21 is a half-round cutout formed in the top end area of the back wall flap 2, and the both ends of the cutout 21 are arranged to connect to a cut perforation 53 scored and formed on the border of the cover plate 5 and back wall flap 2.

14 is the overlap width for adhesive arranged to lead connectively to the end portion of the front wall flap 4, which is arranged to contact to and bond with the inside of the end of the left wall flap 1.

52 and 62 are the adhesive applied to and formed on the back of the fold tongue flap 51 and 61, which is arranged to bond solidly with the surface side of the inner frame body B at the time of fabrication.

The sheet of paper for constructing the inner frame body B is constituted as of a size for fitting approximately closely into the inside of the box body A at the time of fabrication, and is arranged to have the right side wall flap B1, back wall flap B2, left side wall flap B3, front wall flap B4 and overlap width B5 connected one by one and at the same time to have the cover plate flap B6 and base plate flap B7 led foldably and connectively to the top and bottom of the front wall flap B4.

B41, B41 of the drawings are the contact surface of the fold tongue flaps 51 and 61 of the box body A.

Figure 6:
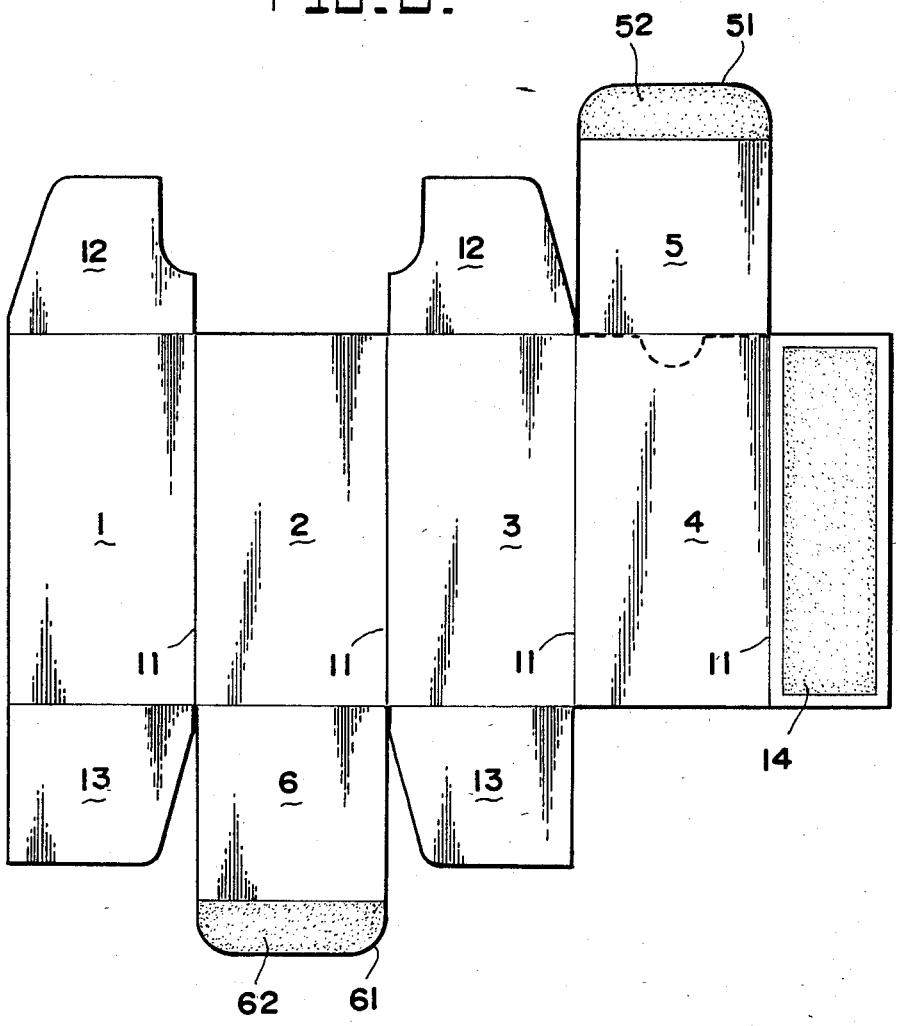
FIG. 6 is an expanded plan view of the box body showing another embodiment of the present invention.

Furthermore, the constitution mode for the box body A, as illustrated in FIG. 1 is not limited to that the cover plate 5 and base plate 6 are seen in its blocked-off state as so-called "straight type" which locates both tongue flaps to become opposite each other, but, as illustrated in FIG. 6, is free to construct as so-called "reversible type" so as not only to be arranged to lead connectively to either one of the cover plate or base plate flap but to get the tongue flap portion inserted toward the reverse direction by arranging the other of the above two plate flaps to lead connectively to the bottom wall flap 2.

Figure 7:
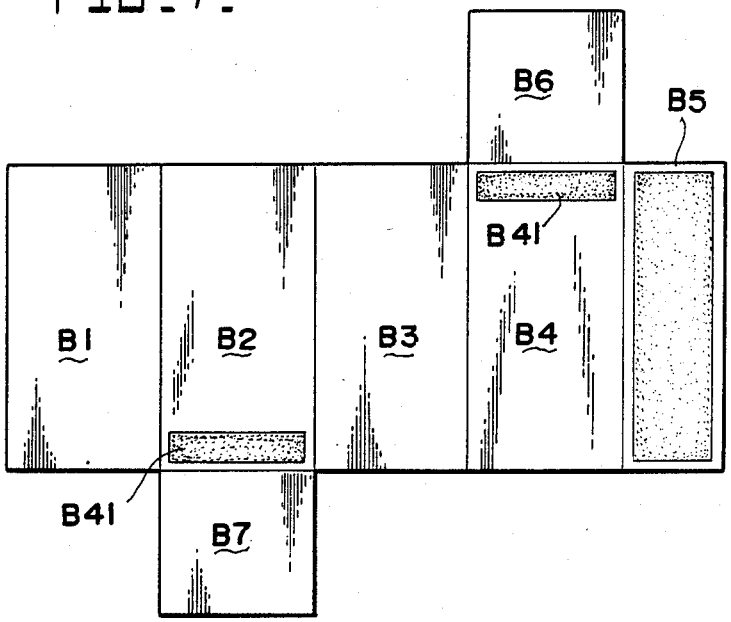
FIG. 7 is an expanded plan view showing the inner frame body of the another embodiment of the present invention.
Figure 8:
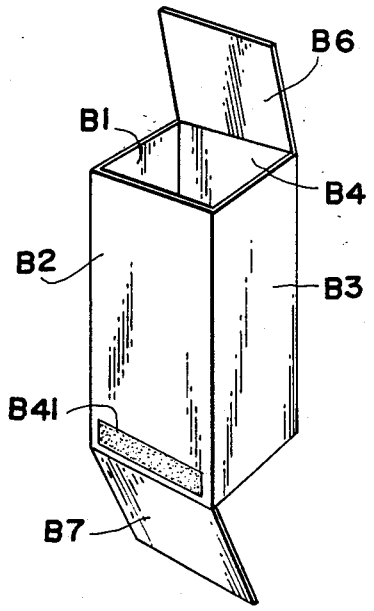
FIG. 8 is a perspective view of the fabricated state for the FIG. 7.

The construction mode for the inner frame body B is not limited to either of the one illustrated in FIG. 2 to FIG. 5, but it is free to change the same to the following construction for use:

(1) So as to get a reverse direction of folding of the cover plate flap B6 and base plate flap B7 which are arranged to lead connectively to the top and bottom of the inner frame body respectively (See FIG. 7 and FIG. 8).

Figure 9:
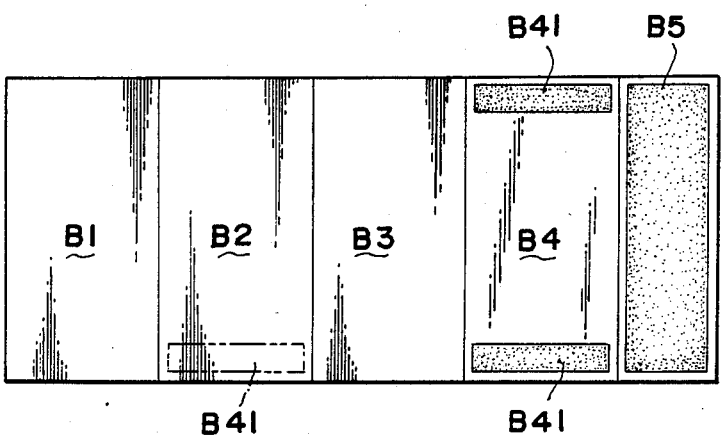
FIG. 9 is an expanded view showing a further embodiment of the present invention.
Figure 10:
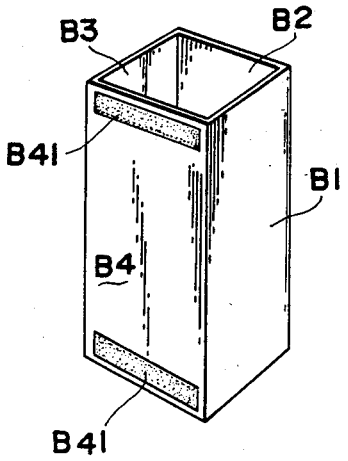
FIG. 10 is a perspective view showing the fabricated state for the FIG. 9.
Figure 11A:
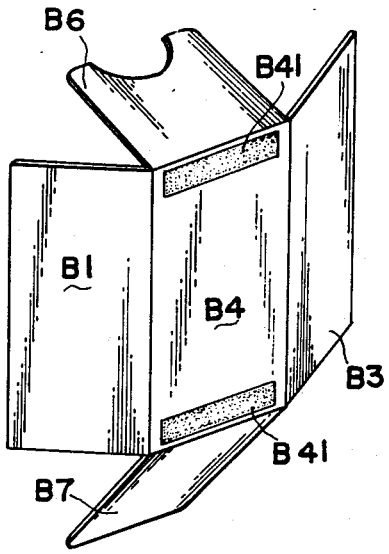
FIG. 11 is a perspective view showing an another further embodiment of the invention.
Figure 11B:
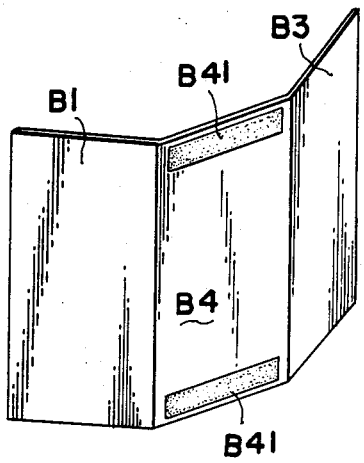
Figure 11C:
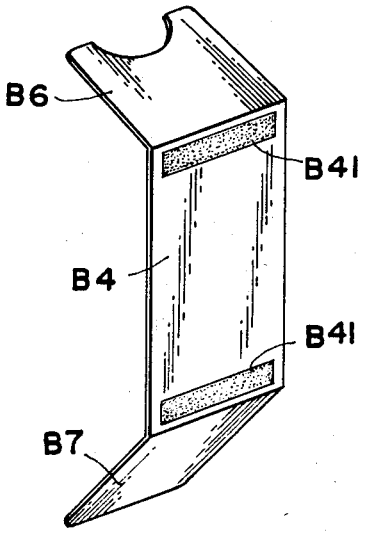
Figure 11D:
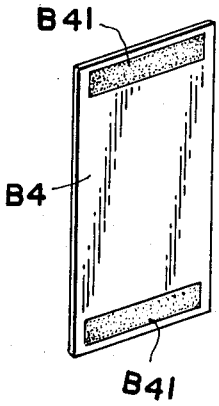

(2) So as to constitute the inner frame body B as a simple cylindrical body with cover plate and base plate both omitted. (See FIG. 9 and FIG. 10)

(3) So as not to form the inner frame body as a cylindrical body but to form the same as a U-shaped section body only with the front wall flap B4 and side wall flap B1, B3 connected to the sides thereof and arrange the cover plate B6 and base plate B7 to lead connectively to the both ends of top and bottom of the front wall flap B4 (See FIG. 11(*a*)).

(4) So as to form the inner frame body B as a U-shaped section body only with the front wall flap B4 and right side wall flap B1 and left side wall flap B3 which are connected to the both sides thereof (See FIG. 11(*b*)).

(5) So as to constitute the inner frame body B only with the front wall flap B4 and the cover plate B6 and bottom plate B7 connected to the top and bottom thereof (See FIG. 11(*c*)).

(6) So as to constitute the inner frame body only with one sheet of paper corresponding to the front wall flap (See FIG. 11(*d*)).

Now, how to fabricate the box body of the present invention constituted as mentioned above will be described, as follows: (There are two methods for this)

(1) To supply materials simultaneously, on the occasion of automatic mechanical (cartoner) fabrication of the box body A, for the box body A and the inner frame body B and bond mechanically both bodies together simultaneously.

(2) To bond in advance the inner frame body B with the box body A before fabricating the whole box body.

Out of the above mentioned methods, method (1) is optimal in the case of the inner frame body recessed into the box body A exhibiting a cylindrical construction (as illustrated in FIG. 1 to FIG. 10), while method (2) is optimal in the case of the inner frame body exhibiting a non-cylindrical construction (See FIGS. 11(*a*) to (*d*).

In either case, the inner frame body, on the occasion of fabricating the whole box body, is contactingly recessed so as to get the both end portions of top and bottom of the front wall flap B4 contacted to the inside of the front wall flap 4 of the box body A (in the case of the straight type, see FIG. 7, FIG. 8 and each figure of FIG. 9 except the portion lined with . . . ) or, in the case of the reversible type, the top end portion of the front wall flap B4 and the bottom end portion of the back wall flap B2 are contactingly recessed into the inside of the front wall flap 4 of the box body A and inside of the back wall flap 2, thereby the integration of the both bodies is intended.

The whole box body so constituted by the integration of the box body A and inner frame body B can be completely fabricated with such procedures after contents such as medical supplies and the like were received inside, folding the inner cover flaps 12, 12 and innerbottom flaps 13, 13 arranged to lead connectively to the both top and bottom of left wall flap 1 and right wall flap 3, then from upward thereof, folding the cover plate flap 5 and bottom plate flap 6, and inserting the fold flaps 51 and 61 so as to position them behind the inner frame body B.

In this case a rigid adhesive block-off is intended by contacting the adhesive 52 and 62 applied to and formed on the back of the fold flaps 51 and 61 arranged to lead connectively to the tip of the cover plate flap 5 and base plate flap 6 to the both surfaces of top and bottom of the inner frame body.

The present invention is constructed as described above, the whole box body can consequently be bonded at both surfaces of top and bottom of the frontwall flap B4 or the both surfaces of top end of the front wall flap B4 and bottom end of the back wall flap constituting the inner frame body B to the adhesive coated surfaces 52, 62 formed in the back of the fold tongue flaps 51, 61 arranged to lead connectively to the tip of the cover plate flap 5 and bottom plate flap 6.

As described above, the adhesive surface according to the present invention is positioned at the side which can not at all be touched from outside, consequently, even if edge tools such as a knife or the like are inserted into the fabricated box for the purpose of tearing, the inserted edge tools only move between the back of the fold tongue flaps 51, 61 and the front wall plate 4 which never allows an improper tear and permitted to completely eliminate the risk held by the conventional packaging box for improper tearing from the fold tongue flap portion.

Further, the present invention has made it possible to use a conventional box body known previously together with the box body A as a sheathing body, it consequently has also brought excellent result from the economy point of view without a rise in product cost.

What is claimed is:

1. A tamper-resistant packaging box structure comprising an outer box having a front wall, side walls, a back wall, a base and a top cover flap extending from the back wall and including a foldable tongue at a forward end thereof for insertion internally of the box body along a top portion of the front wall, the structure further comprising a separate inner box frame inserted inside of the outer box body, said frame including a front panel situated adjacent to the front wall of the outer body, said tongue fitting between the front wall and said panel, said tongue further having adhesive on an inner surface thereof securing same to said panel.

2. The invention of claim 1 wherein said front wall, side walls and back wall together comprise a folded five-panel structure with one of the side walls comprising opposite-end panels of the five-panel structure secured together one over the other.

3. The invention of claim 1 wherein the base comprises a base flap with a fold-in tongue, said fold-in tongue fitting between the front wall and said front panel and also being secured by adhesive to said front panel.

4. The invention of claim 1 wherein the front panel comprises a part of an inner box body also having at least side and back panels.

* * * * *